United States Patent [19]

Parenti

[11] 4,116,570

[45] Sep. 26, 1978

[54] TOOTHBRUSH WITH CARTRIDGE CHAMBER

[76] Inventor: Ronald Parenti, 231 Bryn Mawr Ave., Roselle, Ill. 60172

[21] Appl. No.: 739,618

[22] Filed: Nov. 8, 1976

[51] Int. Cl.[2] ..... A46B 11/04

[52] U.S. Cl. ..... 401/155; 401/286

[58] Field of Search ..... 401/155, 152, 156, 282, 401/286, 287; 222/103

[56] References Cited

U.S. PATENT DOCUMENTS

| | | | |
|---|---|---|---|
| 818,000 | 4/1906 | Stevenson | 401/155 |
| 1,400,954 | 12/1921 | Holloway et al. | 401/155 X |
| 2,489,940 | 11/1949 | Trotta | 222/103 |
| 3,938,897 | 2/1976 | Craig | 401/1 |

FOREIGN PATENT DOCUMENTS

| | | | |
|---|---|---|---|
| 1,158,903 | 9/1955 | France | 40/155 |

*Primary Examiner*—Stephen C. Pellegrino
*Attorney, Agent, or Firm*—Knechtel, Valentino, Demeur & Dallas

[57] ABSTRACT

There is disclosed a toothbrush and paste cartridge assembly which includes a toothbrush formed by a handle having a hollow interior and terminating in a closed bristle portion at one end and being open at the opposed end, the toothbrush handle provided with an elongate slot extending along the length thereof, the slot provided with a plurality of pusher positioning nibs, pusher means reciprocally carried on the toothbrush adapted for travel along the length of the hollow interior, the pusher means provided with pusher stop means in cooperating relation with the pusher positioning nibs to permit positioning of the pusher means at a plurality of stop positions along the length of the handle, the hollow interior of the toothbrush including a chamfered section positioned adjacent to closed bristle end, the chamfered section in turn, terminating in a nozzle section, and the nozzle section being disposed arcuately in the direction of and in open communication with closed bristle portion of the toothbrush, in a preformed and prefilled toothpaste cartridge constructed in size for insertion and nesting within the hollow interior of the toothbrush handle, the cartridge formed by an elongate body portion, a tapered neck portion adjacent the forward end thereof and terminating in a substantially flexible nozzle, the cartridge being insertable in the toothbrush handle hollow portion when the pusher is in the raised section of the handle such that the cartridge nozzle inserts within and nests within the nozzle portion of the hollow interior with the pusher means operating to eject toothpaste from the cartridge as the pusher is reciprocated forward and permitting a plurality of stop positions by a pusher stop means cooperating with the pusher positioning means in the slot.

1 Claim, 4 Drawing Figures

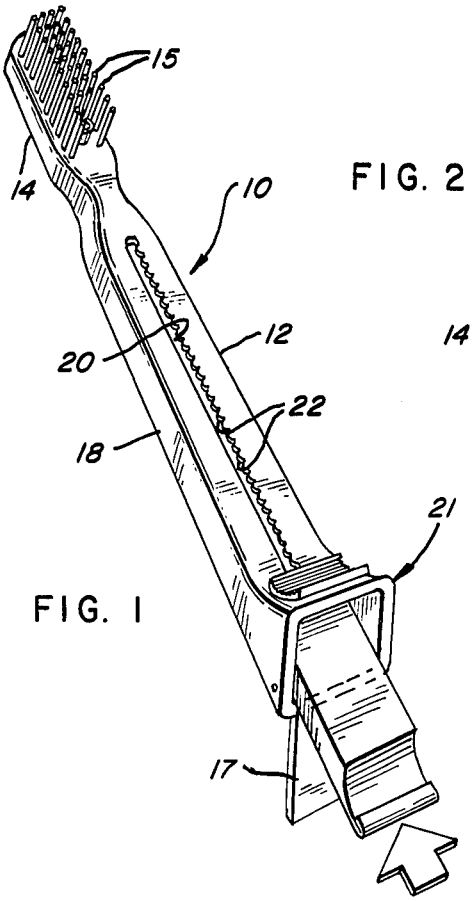
FIG. 1
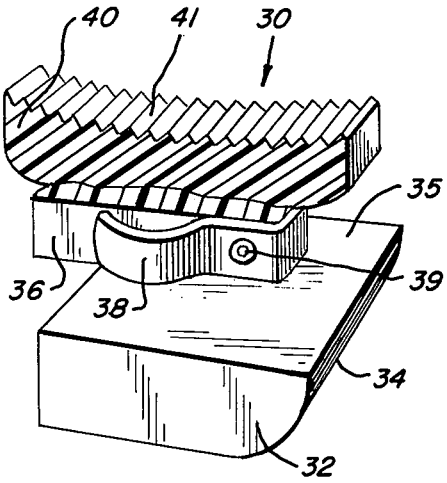
FIG. 4
FIG. 2
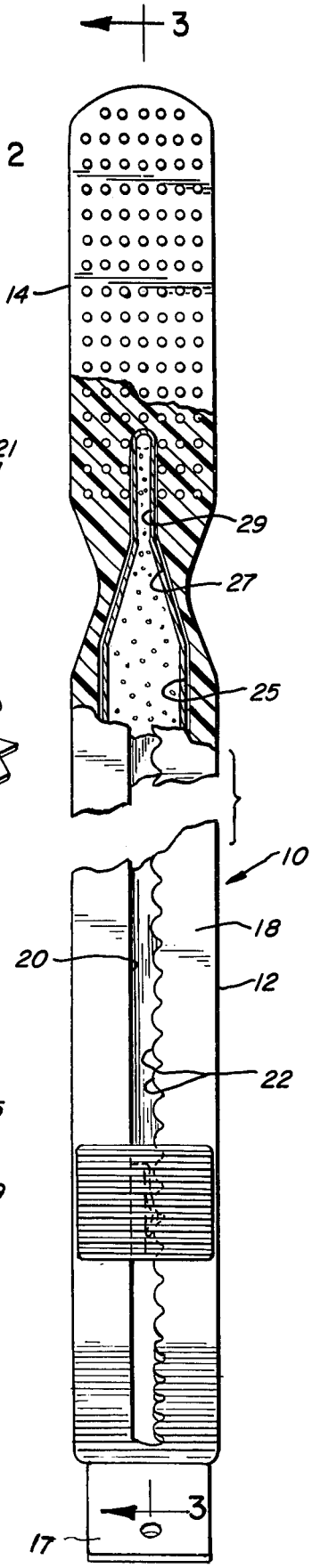
FIG. 3
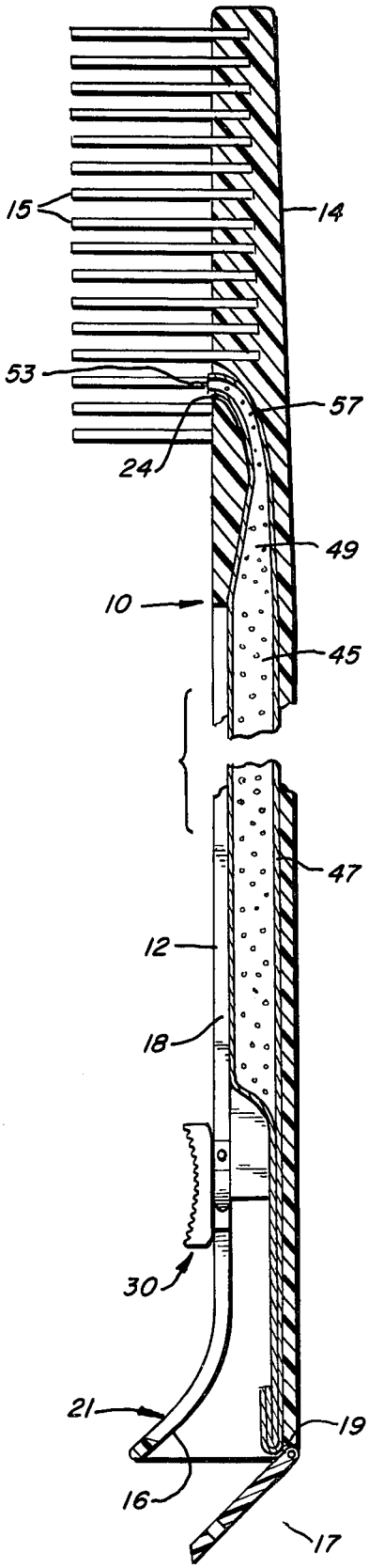

TOOTHBRUSH WITH CARTRIDGE CHAMBER

BACKGROUND OF THE INVENTION

It has become apparent in recent years that the consumer market relating to toiletry items has resulted in the development of a number of time saving devices which are intended for ease of use. For example, the shaving industry has developed improved razors which permit the changing of the blade assembly by simply providing a cartridge containing either a single or a double razor edge which is replaceable on a handle assembly by simply ejecting one cartridge and inserting a new cartridge. Generally, developments in this art field have been evolved as a result of the desire for compactness and ease of use.

In connection with the concern for dental hygiene, it is fairly commonplace that a toothbrush is employed by only the owner thereof in order to insure that germs and other diseases not be transmitted from one person to another. In view of the fact that a toothbrush is an item which is employed only by the owner thereof, it has been proposed that toothbrush assemblies be developed which incorporate a cartridge assembly of some sort which would be manufactured as a preformed and prefilled toothpaste cartridge, and which would be insertable within the toothbrush provided with an ejector mechanism of some kind such that the toothpaste may easily be ejected from the cartridge into the bristle portion of the brush. In this manner, a compact and easy to use toothbrush assembly would be provided to the consuming public.

There have been a number of such proposed toothbrush assemblies in the prior art, however, none of these assemblies has had much commercial success. In most instances, such devices have been known to be cumbersome, or alternatively, have been constructed in such a manner as to require a plurality of pieces and parts thereby increasing the manufacturing costs and hence, removing the item from the easy reach of the consuming public from a cost standpoint. Hence, none of the prior devices has achieved any degree of commercial success.

For example, it will be observed that in U.S. Pat. No. 2,717,101, a paste type dentifrice dispensing toothbrush assembly is illustrated. As shown therein, the toothbrush is generally provided with a head portion which accommodates a screw threaded cartridge containing the dentifrice paste. A pusher assembly is provided to eject toothpaste from the cartridge through an opening therein, into an opening provided in the bristled head of the toothbrush. It is apparent from a review of the drawings as well as the specification on U.S. Pat. No. 2,717,101 that a toothbrush assembly constructed in accordance with the teachings thereof would be somewhat expensive to produce, but the reason that the cartridge requirements are such that the cartridge would have to be formed of a relatively stiff hard plastic since the cartridge itself functions as the handle. It will, therefore, be appreciated that to manufacture preformed and prefilled paste cartridges of this type would be extremely expensive to the ultimate consumer and hence, a toothbrush assembly of the type depicted therein is not a practical device.

Other devices have similarly been proposed such as, for example, the device shown in U.S. Pat. No. 2,612,649. In this device, it is contemplated that a flexible refillable cartridge is employed for containing a quantity of the dentifrice cleaning liquid to be employed by the user. Once again, it is intended that manually operably means are employed in order to eject fluid from the cartridge into the brush. As described therein, the manually operable means comprises a bar which may be manually forced downwardly by means of a pressure knob which extends through the toothbrush handle. Hence, while the ejection is not formed by any reciprocating mechanism, nevertheless, there is an attempt to accomplish the same function by providing an operating or pressure bar. A drawback of the assembly shown in U.S. Pat. No. 2,612,649 is the fact that the dentifrice ejection means which is manually operable will not operate to eject a volume of the dentifrice from the forward end of the cartridge. Hence, the user would end up wasting a considerable amount of dentifrice toothpast which the bar would not be capable of expending from the forward end of the cartridge. Hence, devices of the type depicted therein have similarly not achieved any level of success mainly because such devices are clumsy in design and wasteful in terms of the amount of dentifrice which is incapable of being utilized.

Another form of a toothbrush containing a dispensing chamber as shown in U.S. Pat. No. 2,162,447. Once again, it is intended that a reuseable or refillable type cartridge is to be introduced into a magazine or a chamber within the toothbrush handle wherein an ejection means is provided for ejecting the dentifrice from the cartridge through an opening into the bristle portion of the brush. As further depicted therein, the assembly is provided with a feed nozzle which operates to puncture the membrane of the toothpaste cartridge inserted therein. A compression roller is provided which reciprocates along a slot provided in the handle and operated by means of a thumb grip portion extending outwardly therefrom. The cartridge is insertable within the handle by opening the handle at the pivot point accommodated by the hinge which hinges one portion of the handle to the head section of the toothbrush.

It will be appreciated from the above description that a number of parts are required in order to construct a toothbrush in accordance with the teachings of U.S. Pat. No. 2,162,447. As such, the subject device becomes extremely expensive to manufacture and, therefore, is not practical insofar as a commercial device is concerned. In addition, it would be somewhat difficult from an expense standpoint to form a toothbrush head having a feed nozzle constructed and incorporated therein for the reason that if it is contemplated to construct the toothbrush head out of a plastic material, then a mold would have to be constructed to conform to this structure. This is an extremely difficult structure to incorporate in a mold on any reasonable basis, and hence, overall, the toothbrush assembly as shown in U.S. Pat. No. 2,162,447 would be costly to manufacture.

OBJECTS AND ADVANTAGES

It is, therefore, the principal object of the invention to provide an improved and simplified toothbrush and toothpaste cartridge assembly which is simplified in terms of construction as well as in terms of ease of use.

In connection with the foregoing object, it is a further object of the invention to provide an improved toothbrush and paste cartridge assembly which includes a toothbrush formed by a handle defined by an exterior wall and having a hollow interior, and a toothbrush terminating in a closed bristle portion at one end and open at the opposed end, the wall of the toothbrush handle provided with an elongate slot extending the length thereof, the slot provided with a plurality of pusher positioning means along the length thereof, pusher means reciprocally carried on the toothbrush and adapted for travel along the length of the hollow interior of the toothbrush handle, the pusher means provided with pusher stop means in cooperating relation with the pusher positioning means provided in the slot in order to permit the positioning of the pusher means at a plurality of stop positions along the length thereof, the hollow interior of the toothbrush handle including a chamfered section and a nozzle section and wherein the nozzle section is disposed arcuately in the direction of and in open communication with the closed bristle portion of the toothbrush, and further including a preformed and prefilled toothpaste cartridge constructed in size for insertion in the hollow interior of the handle, the cartridge similarly formed by an elongate body portion, a tapered neck portion and termining in a substantially flexible nozzle. The chamfered section and nozzle section of the hollow interior operates as a guide for the tapered neck portion and nozzle portion of the cartridge thereby to positively position the cartridge in proper disposition for use within the handle of the toothbrush without the need for any extraneous parts or elements in order to effect proper positioning.

In connection with the foregoing object, it is a further object of the invention to provide a toothbrush assembly of the type described wherein the pusher means is formed by a pusher block sized and proportioned to be reciprocally moveable within the confines of the hollow interior and wherein the pusher bar includes an elongate rail mounted thereon, the rail being sized and proportioned to slide along the confines of the slot and including pusher stop means carried on the rail, and further including thumb grip means carried on the rail and extending beyond the confines of the slot to provide a gripping surface to facilitate reciprocation of the pusher block within the hollow interior of the toothbrush by the operator thereof.

It is still a further object of the invention to provide a toothbrush assembly of the type described wherein the open end of the toothbrush handle is provided with a door pivotally mounted to the handle wall in order to permit the opening and closing of the entryway to the hollow interior of the handle in order to permit ease of insertion of a toothpaste cartridge therein.

Still in connection with the above objects, it is a further object of the invention to provide a toothbrush assembly of the type described wherein the cartridge containing the toothpaste includes a nozzle formed of a flexible and frangible material such that the nozzle may be easily torn prior to use such that upon positioning of the cartridge within the toothbrush handle, the pusher means may be reciprocated to eject toothpaste from the cartridge through the open channel into the bristle portion of the brush.

In connection with the foregoing object, it is yet a further object of the invention to provide a toothbrush assembly of the type decribed wherein the cartridge is further improved by providing the nozzle section thereof with a serrated tear line in the nozzle section to permit ease of tearing in order to gain access to contents of the cartridge when positioned within the toothbrush handle.

Further features of the invention pertain to the particular arrangement of the elements and parts whereby the above outlined and additional operating features thereof are attained.

The invention, both as to organization and method of operation, together with further objects and advantages thereof, will best be understood by reference to the specification below, taken in connection with the accompanying drawings.

BRIEF DESCRIPTION OF DRAWINGS

FIG. 1 is a perspective view showing the toothbrush assembly of the present invention including both the toothbrush handle and cartridge assembly.

FIG. 2 is a back elevational view, partly in cross section, showing the construction of the handle assembly including the interior hollow chamber thereof;

FIG. 3 is a side elevational view, in cross section, showing the construction of the handle assembly and the manner in which the cartridge is positioned therein, taken in the direction of the arrows along the line 3—3; and FIG. 4 is a perspective view showing the details of construction of the pusher block utilized in connection with the toothbrush handle assembly.

BRIEF SUMMARY OF INVENTION

In summary, the present invention provides a simplified version of a toothbrush assembly formed by a toothbrush having a hollow handle which accommodates the insertion of a cartridge therein, and wherein the hollow interior portion of the handle is constructed with a chamfered section as well as a nozzle section in order to properly position a cartridge insertable therein. The cartridge, in turn, is similarly constructed such that the same nestingly mates with the chamber within the handle and hence, the shape and size of both the hollow interior chamber as well as the cartridge will effect proper positioning of the cartridge without any extraneous elements. In addition, the toothbrush assembly of the present invention provides an improved while simplified pusher structure for ejecting toothpaste from the cartridge into the bristle portion of the brush. The pusher element is formed by a pusher block constructed with a rail which rides in the slotted portion of the toothbrush handle and includes a knurled thumbgrip section which extends upwardly beyond the confines of the slot to permit ease of use by the operator. The pusher block is sized to effectly consume the greater portion of space within the chamber as the same reciprocates forwardly such that essentially all of the toothpaste contained within the cartridge will be ejected by the pusher block until the entire cartridge has become expended. Hence, very little toothpaste in the cartridge will be wasted when the cartridge is disposed of.

DETAILED DESCRIPTION OF THE DRAWINGS

As shown in the drawings, the toothbrush assembly is generally referred to by the numeral 10 and is generally shown to be formed by a handle portion 12 terminating at the forward end in a bristled portion 14 which carries bristles 15 as is common in connection with toothbrushes. The opposed end of the toothbrush 10 is shown to be open as represented by the numeral 16 thereby to accommodate the insertion therein of a cartridge as generally shown in FIGS. 1 and 3 of the drawings.

The handle portion 12 is defined by an exterior wall generally represented by the numeral 18 and is generally rectangular in cross section. The bristled side of the handle 12 is shown to be provided with an elongate slot 20 which extends the substantial length of the handle 12. It will also be observed that the elongate slot 20 includes a plurality of nibs 22 extending along the entire length thereof. The nibs function as the stop positions in a manner which will be more clearly defined hereinafter. As shown in FIG. 3 of the drawings, the open opposed end 16 of the handle 12 may be provided with a door 17 which is pivotally secured to the handle 12 by means of a pivot pin 19 and is adapted to frictionally engage the exterior wall 18 in a manner to close the open end 16 once the cartridge has been inserted therein.

As shown in FIG. 4 of the drawings, the details of the pusher element 30 are shown. The pusher element 30 includes the pusher block 32 which is sized and proportioned to fit within and ride within the hollow interior portion of the handle 12 as more clearly shown in FIG. 3 of the drawings. The pusher block 32 is formed with an arcuate nose 34 which further facilitates and simplifies the ejection of the toothpaste from the cartridge in a manner to be more fully described hereinafter. The pusher block 32 includes a top surface 35 which carries pusher rail 36 thereon. Pusher rail 36 is sized and proportioned to fit within the confines of the elongate slot 20 and therefore, rides within the slot 20 in the manner shown in FIGS. 3 and 4 of the drawings. The rail 36 is further provided with a stop boss 38 which is secured to the pusher rail 36 by any appropriate means such as a pin 39. Alternatively, the stop boss 38 may simply be formed integrally with the pusher rail 36 and the entire pusher element 30 may be molded as a unitary element if so desired.

The pusher element 30 is completed by the thumb grip member 40 which includes a knurled top surface 41 which facilitates the thumb gripping procedure. The thumb grip member 40 rides above the pusher rail 36 and hence, rides beyond the confines of the elongate slot 20. As shown in FIG. 3 of the drawings, the user or operator of the device may simply grasp the knurled surface 41 of the thumb grip 40 in order to advance the pusher element 30 along the hollow interior of the handle 12. As the pusher block 32 is advanced along the hollow interior, and assuming that the cartridge is properly positioned with the toothbrush handle 12, toothpaste will be ejected from the cartridge, again in a manner to be more fully described hereinafter.

As particularly shown in FIGS. 1 and 3 of the drawings, the top wall of the handle portion 12 which includes the elongate slot 20 shown to further include an upwardly extending arcuate section generally represented by the numeral 21. As shown in FIG. 1 of the drawings, the elongate slot 20 extends up along the upward arcuate section 21 such that the pusher element 30 will ride along the elongate slot 20. When the pusher element 30 has been ridden up the arcuate section 21, it will be apparent that the pusher block 32 is retracted out of contact with the cartridge 45. In this posture, the cartridge 45 is easily insertable within the chamber 25 in the manner generally shown in FIG. 1 of the drawings. Hence, this construction permits the ease of replacement of the cartridge 45 within the handle portion 12.

As shown in the drawings, the hollow interior portion of the handle 12 forms a chamber and is generally represented by the numeral 25. The chamber 25 is generally elongate in configuration and further includes a chamfered section 27 adjacent the forward end thereof. The chamfered section 27 terminates in a nozzle section 29 which is shown to have an arcuate configuration, arcuately disposed in the direction of the bristles 15. As shown in FIGS. 2 and 3 of the drawings, the cartridge generally represented by the numeral 45 similarly includes an elongate body section 47 and a tapered neck section 49. The tapered neck section 49 terminates in a flexible nozzle 51.

It will now be appreciated from a review of FIGS. 2 and 3 of the drawings that the configuration of the interior chamber 25 of the handle portion 12, which includes the chamfered section 27 and nozzle section 29, acts as a positive guide for the insertion of the cartridge 45 therein. The chamfered section 27 of the chamber 25 guides and positions the cartridge 45 by accommodating the tapered neck section 49 therein, and also has the effect of positioning the flexible nozzle 51 in the nozzle section 29. In use, it is contemplated that the operator would tear open the tip end of the flexible nozzle 51 prior to the insertion of the cartridge 45 within the handle portion 12, such that once the cartridge 45 is inserted within the handle portion 12, with the flexible nozzle 51 appropriately positioned in the nozzle section 29, the open end of the flexible nozzle 51 will be in open communication with the bristled portion 14 of the brush 10 such that toothpaste contained within the cartridge 45 may be ejected thereon. It will be appreciated from a view of FIG. 3 of the drawings that as the pusher element 30 is reciprocated forwardly to an appropriate position such that the stop boss 38 achieves a stop position with respect to a corresponding nib, toothpaste will be forced out of the nozzle 51 through aperture 24.

It will be appreciated from a view of FIGS. 1 and 3 of the drawings that due to the the construction whereby the slot 20 extends a substantial length along the handle portion 12, the pusher element 30 is permitted a substantially complete line of travel along the entire length of the cartridge 45. In this manner, it is assured that substantially all of the toothpaste will be ejected onto the bristle portion 14 of the toothbrush 10 thereby minimizing waste as the cartridge 45 are expended and replaced. The cartridge 45 may also be conveniently provided with a tear line generally represented by the numeral 53 (FIG. 3) thereby to simplify the tearing procedure in order to ready the cartridge 45 for insertion in the toothbrush 10. The user would merely tear off the closed end portion of the nozzle 51 along the tear line 53 in order to ready the cartridge 45 for insertion in usage.

The cartridge 45 may also be conveniently provided with a crimped portion along the tear line 53. The crimped portion may be formed during the manufacturing procedure for the cartridge 45 such that upon tearing the end of the nozzle 51 along the tear line 53, the open end of the nozzle 51 will remain in a crimped posture. The advantage to this construction is that the toothpaste contained within the cartridge 45 will be retained within the cartridge 45 until such that as the pusher element 30 is moved forwardly causing the pusher block 32 to press against the sides of the cartridge 45 to force toothpaste through the crimped portion. Hence, when not in use, the crimped portion will come to normally retain the open end of the nozzle 51 in a crimped posture and prevent toothpaste from running out of the open end of the nozzle 51.

It will be appreciated that by virtue of the invention herein, a mechanically simplified version of a toothbrush having a cartridge chamber and an improved cartridge have been provided. It will be appreciated that the toothbrush assembly of the present invention is simplified in construction thereby minimizing manufacturing costs while at the same time providing a device which is, mechanically, simple in use. In addition, by providing a cartridge assembly which requires no moving parts associated therewith, and is simply used by tearing off the nozzle end thereof, sterile conditions can be maintained at all times without the requirement for any puncturing element or other element which would interface with the toothpaste contained within the cartridge. It will therefore be appreciated that all of the above objects and advantages have been attained by virtue of the present invention and an extremely compact and low cost toothbrush assembly has been provided.

While there has been described what is at present considered to be the preferred embodiment of the invention, it will be understood that various modifications may be made therein and it is intended to cover in the appended claims all such modifications as fall within the true spirit and scope of the invention.

What is claimed is:

1. A toothbrush and paste cartridge assembly comprising in combination a toothbrush formed by a handle defined by an exterior wall and having a hollow interior, and terminating in a closed bristled portion at one end and being open at the opposed end thereof, said wall of said toothbrush handle provided with an elongate slot extending the substantial length of said toothbrush, said slot provided with a plurality of pusher positioning means positioned along the length thereof, said pusher positioning means formed by a plurality of nibs positioned along and formed integrally with the lateral confines of said slot, pusher means reciprocally carried on said toothbrush and adapted for travel along the length of said hollow interior of said toothbrush, said pusher means formed by a pusher block sized and proportioned to be reciprocally movable within the confines of said hollow interior of said toothbrush handle, an elongate rail mounted on said pusher block, said rail being sized and proportioned to slide within the confines of said slot, said pusher means being further provided with pusher stop means in cooperating relation with said pusher positioning means provided in said slot thereby to permit positioning of said pusher means at a plurality of stop positions along the length of said toothbrush handle, said pusher stop means formed by a stop boss carried on said rail and positioned to be in cooperative relation with said plurality of nibs whereby said stop boss is in frictional contact with said plurality of nibs thereby to effect a plurality of stop positions, thumb grip means carried on said rail and extending, in use, beyond the confines of said slot thereby to provide a gripping surface to facilitate reciprocation of said pusher block within said hollow interior of said toothbrush, said hollow interior of said toothbrush handle including a chamfered section positioned adjacent said closed bristled end, said chamfered section terminating in a nozzle section, said nozzle section being disposed arcuately in the direction of and in open communication with said closed bristled portion of said toothbrush, and a preformed and prefilled toothpaste cartridge constructed and sized for insertion and nesting within the hollow interior portion of said toothbrush handle, said cartridge formed by an elongate body portion, a tapered neck portion adjacent the forward end thereof and said tapered neck portion terminating in a substantially flexible nozzle, whereby said toothpaste cartridge is insertable within the hollow interior of said toothbrush handle with said tapered neck portion matingly nested within said chamfered section of said handle, and said nozzle positioned within said nozzle section of said toothbrush in open communication with said closed bristled portion of said toothbrush, and said pusher means being reciprocally positioned along the length of said slot to eject toothpaste from within said cartridge through said nozzle and into said bristled portion of said toothbrush.

* * * * *